US005297784A

United States Patent [19]

Wagner

[11] Patent Number: 5,297,784

[45] Date of Patent: * Mar. 29, 1994

[54] METHOD AND APPARATUS FOR LIFTING AND DIE-CUTTING SIGNATURES IN SADDLE FORMAT

[75] Inventor: Joerg Wagner, Vancouver, Canada

[73] Assignee: Wagner & Teldon, Richmond, Canada

[ * ] Notice: The portion of the term of this patent subsequent to Oct. 27, 2009 has been disclaimed.

[21] Appl. No.: 966,638

[22] Filed: Oct. 26, 1992

Related U.S. Application Data

[63] Continuation of Ser. No. 680,906, Apr. 5, 1991, Pat. No. 5,158,273.

[51] Int. Cl.[5] ..... B42B 2/00; B65H 39/02

[52] U.S. Cl. ..... 270/53; 270/54

[58] Field of Search ..... 270/53, 54, 55, 56; 83/29, 917

[56] References Cited

U.S. PATENT DOCUMENTS

| | | | |
|---|---|---|---|
| 3,757,970 | 9/1973 | Pfaffle | 83/29 X |
| 4,236,706 | 12/1980 | Schlough | 270/53 |
| 4,260,145 | 4/1981 | Mebus et al. | 270/54 |
| 4,482,141 | 11/1984 | Moser | 270/54 |
| 4,758,214 | 7/1988 | de Bin | 83/29 X |
| 5,114,128 | 5/1992 | Harris, Jr. et al. | 270/55 X |

*Primary Examiner*—Edward K. Look
*Assistant Examiner*—John Ryznic
*Attorney, Agent, or Firm*—Shlesinger, Arkwright & Garvey

[57] ABSTRACT

A method and apparatus of in-line die-cutting in saddle signature gathering wherein signature sets are gathered on a gathering chain to form signature sets. The signature set is grasped by a pair of belts which lift the signature off the gathering line so that a portion of the signature set along the spine thereof may be removed by a die-cutting pair of plates located above the gathering line. The signature sets may be stopped as lifting and cutting occurs. After lifting and cutting the signature set is replaced on the gathering line for further processing.

18 Claims, 8 Drawing Sheets

METHOD AND APPARATUS FOR LIFTING AND DIE-CUTTING SIGNATURES IN SADDLE FORMAT

This is a continuation of application Ser. No. 07/680,906, filed Apr. 5, 1991, now U.S. Pat. No. 5,158,273, issued Oct. 27, 1992.

FIELD OF THE INVENTION

This invention relates to collating and die-cutting signatures and more particularly to a method and apparatus for collating and die-cutting signatures in a saddle format.

BACKGROUND OF THE INVENTION

Saddle gathering format is commonly used in collating multiple pages to create publications such as magazines and calendars. Saddle format means that an individual signature having a central fold line is placed on a moving line or gathering chain. Subsequent signatures each having a central fold line are placed in succession on top of the first signature with their central common fold lines lying together parallel and on top of the gathering line. The signatures are preprinted and their order of placement upon the gathering line is programmed so that upon binding the pages of the magazine or publication are in order. In the ordinary gathering line, the chain moves under the feeding devices. As it acquires more and more signatures, and upon emerging from the last feeding device it will have enough signatures compiled in the proper order to constitute a complete publication. Thereafter, a cover is generally applied and staples or another type of binding is added to hold the compiled signatures together.

Typically after stapling, the cover and the signatures are trimmed so that their margins register. Trimming is necessary because generally a small amount of inconsistencies exists along the edges of the various signatures after gathering.

OBJECTS AND SUMMARY OF THE INVENTION

One of the principle objects of the invention is to provide an in-line die-cutting device which can lift an entire set of collated signatures from the gathering line, die-cut the set of signatures and return the set to the gathering line without interrupting the flow of signatures along the gathering line.

Another object of the invention is to provide a signature lifting device which accelerates and lifts the signature so that the fold line of the signature is raised off the gathering line, moved forwardly keeping pace with the speed of the gathering line and returned to the gathering line downstream.

Still another object of the invention is to provide a die-cutter which reciprocates upstream and downstream of the gathering line to cut and remove sections of sets of signatures as they are traveling down the gathering line.

Yet another object of the invention is to coordinate the lifting and cutting apparatus so that cutting occurs after the signature is lifted off the gathering line.

Another object of the invention is to provide a method of in-line die-cutting in saddle format.

Still another object of the invention is to provide a method for collecting signatures in saddle format, lifting the signatures partially off the gathering line and cutting the signature sets after they are lifted.

In summary, therefore, this invention is directed to method and apparatus for assembling a set of signatures or folded sheets in saddle format, lifting the set of signatures partially off the gathering line, cutting the signatures and replacing them onto the gathering line in order for further processing.

The following example will provide a clearer understanding of the invention. In forming a calendar, three component signatures are gathered on the gathering line and are carried along by a backstop mounted on the line. A backstop is located approximately every two feet of chain. The rear edge of the calendar is the register edge and needs to be seated against the backstop for proper register. Since the backstop could interfere with the cutting operation, the signatures need to be accelerated before cutting. Accelerating the signature set through an increased speed of the lifting belts relative to the speed of the gathering line tends to cause misalignment of the signatures as they are pulled in by the lifting belts. Further the front to back alignment of the cut is controlled by the timing of the signature set passing into the timing belt. Both of these problems are solved by the use of a registration device installed ahead of the die-cutter. It basically is a belt with dogs on it which accelerates the signature set by pushing the signature set into the lifting belts from the register edge. This registration device operates at the same speed as the timing belt in the die-cutter assembly, thus eliminating misalignment.

Once the signature set has passed from the registration device completely into the grip of the lifting belts, the lifting assembly raises the signature spine off the carrier chain to the required height so that the male/-female die-cutter plates operating just above the gathering line can cut the signature set. Registration of the depth of the cut from the spine going down is accomplished by adjusting the lifting height of the lifting assembly. Front to back positioning of the cut is adjusted generally by experimentation and adjusting the speed of the gathering line and finely adjusted by the speed of the registration device belt.

The motion of the signature set can be stopped for an instant during the cutting of the operation. Stopping the motion of the signature set permits a precise, clean cut. Each cutting die is attached on a bar connected front and back to a reciprocating mechanism, so that the two die halves move out and back in the backup stroke and move in and forward in the cutting stroke. The die-set is guided by riding on tubular guides. The speed of the forward movement during cutting is matched to the speed of the timing belt.

The lifting assembly lowers the cut signature set back to chain level after the cutting operation and the product passes out of the timing belts.

A mechanical device, such as a brush or steel band then contacts the signature set so that each signature again comes to rest against the backstop in time for the cover to be added onto the gathering line. The cover is also registered against the backstop.

The die-cutting assembly and the registration device are both driven by belts off the same line shaft that drive all other components of the saddle sticher, including the gathering line and is thus mechanically speed matched.

In the die-cutting assembly, "non-cutting" control is achieved by a clutch mechanism designed to disengage the lifter cam shaft.

In the cover-feeder control, a solenoid valve cuts off a pickup vacuum to prevent covers from being placed on incomplete or rejected signature sets and prevents covers from being wasted.

These and other important objects and features of the invention will be further described with reference to the accompanying drawings and detailed description of the invention.

DETAILED DESCRIPTION

Figure 1:
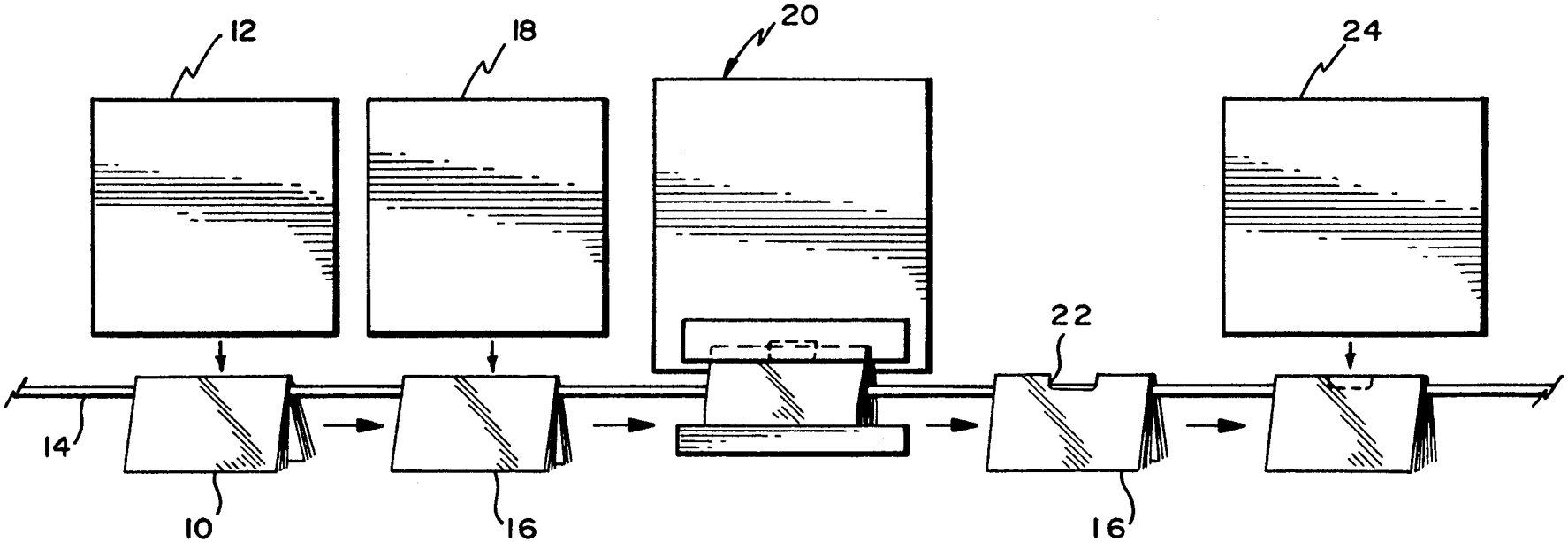
FIG. 1 is a schematic view of the saddle format gathering apparatus.
Figures 2, 3:
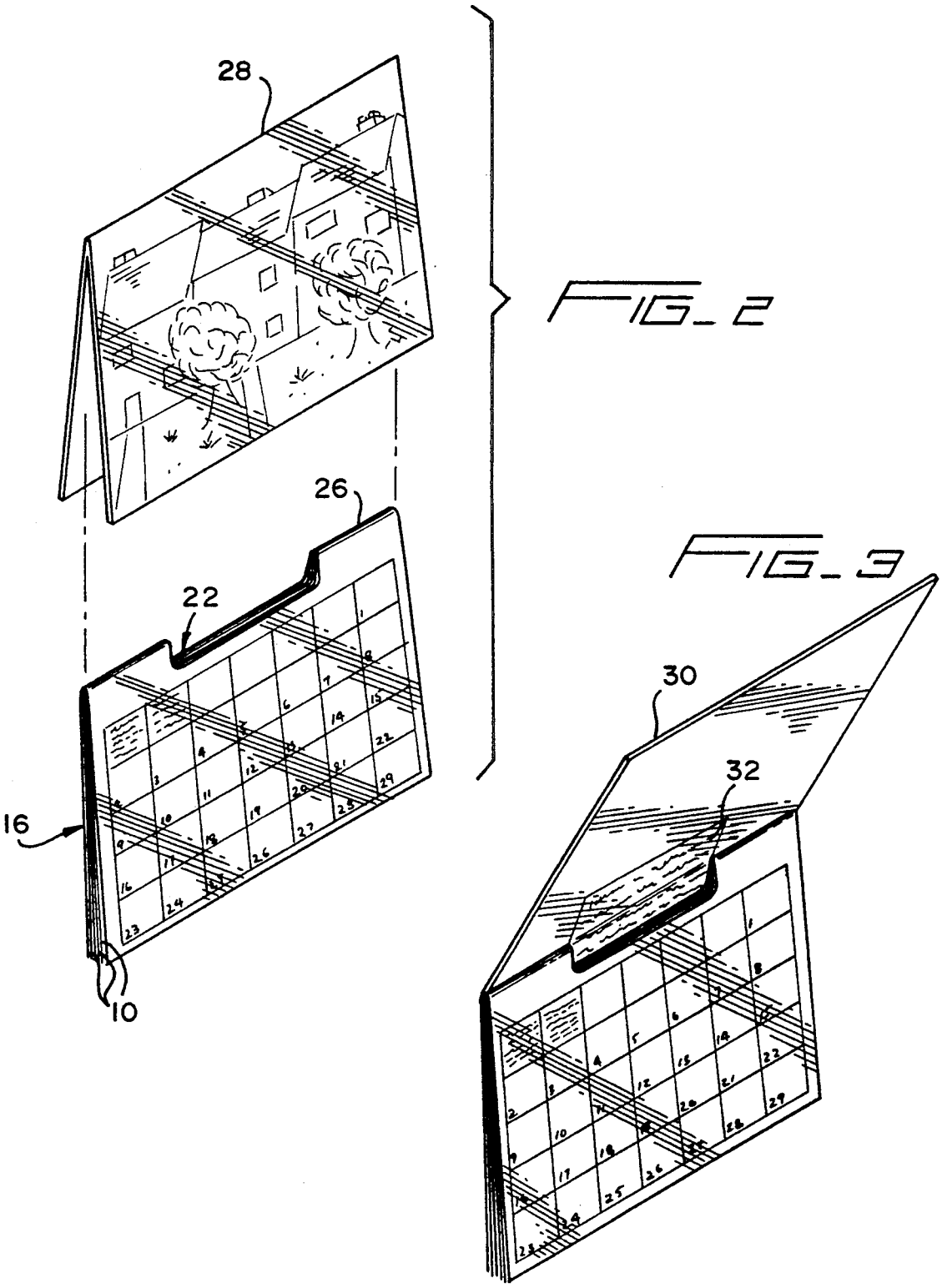
FIG. 2 is an exploded view of the signature set forming a calendar and having a cut-out portion subsequent to cutting and showing the cover ready for attachment thereto; and, FIG. 3 is the completed calendar showing the advertising section visible in the space created by the cut-out portion.

FIGS. 1-3 shows a schematic view of a saddle format bindery process showing individual signatures 10 being assembled at a series of feeder hoppers 12. A gathering line 14 carries the signatures 10 along through the feeder hoppers 12 and successive signatures 10 are draped over the gathering line 14 to build up a completed signature set 16. The completed signature set 16 passes from the feeder hopper 18 and continues along gathering line 14 until it reaches a registration device (not shown) which accelerates the signature set 16 into the die-cutting apparatus 20. After leaving the die-cutting apparatus 20, the signature set 16 has a cut-out 22 and passes under cover feeder 24. The die-cutting apparatus 20 will be further described with reference to FIGS. 4-9.

FIG. 2 shows a completed signature set 16 having a cut-out 22 in which all of the signatures 10 have a portion of the spine 26 removed. After completion of the die-cutting of the completed signature set 16, the cover 28 is added from cover hopper 24 and connected to the signature set 16 by suitable fastening means such as stapling.

FIG. 3 shows the completed calendar 30 with the cover 28 open to reveal the advertising indicia 32 which is visible throughout the year. As the calendar pages are lifted, the cut-out 22 forms a frame about the indicia 32.

FIGS. 4-9

Figure 4:
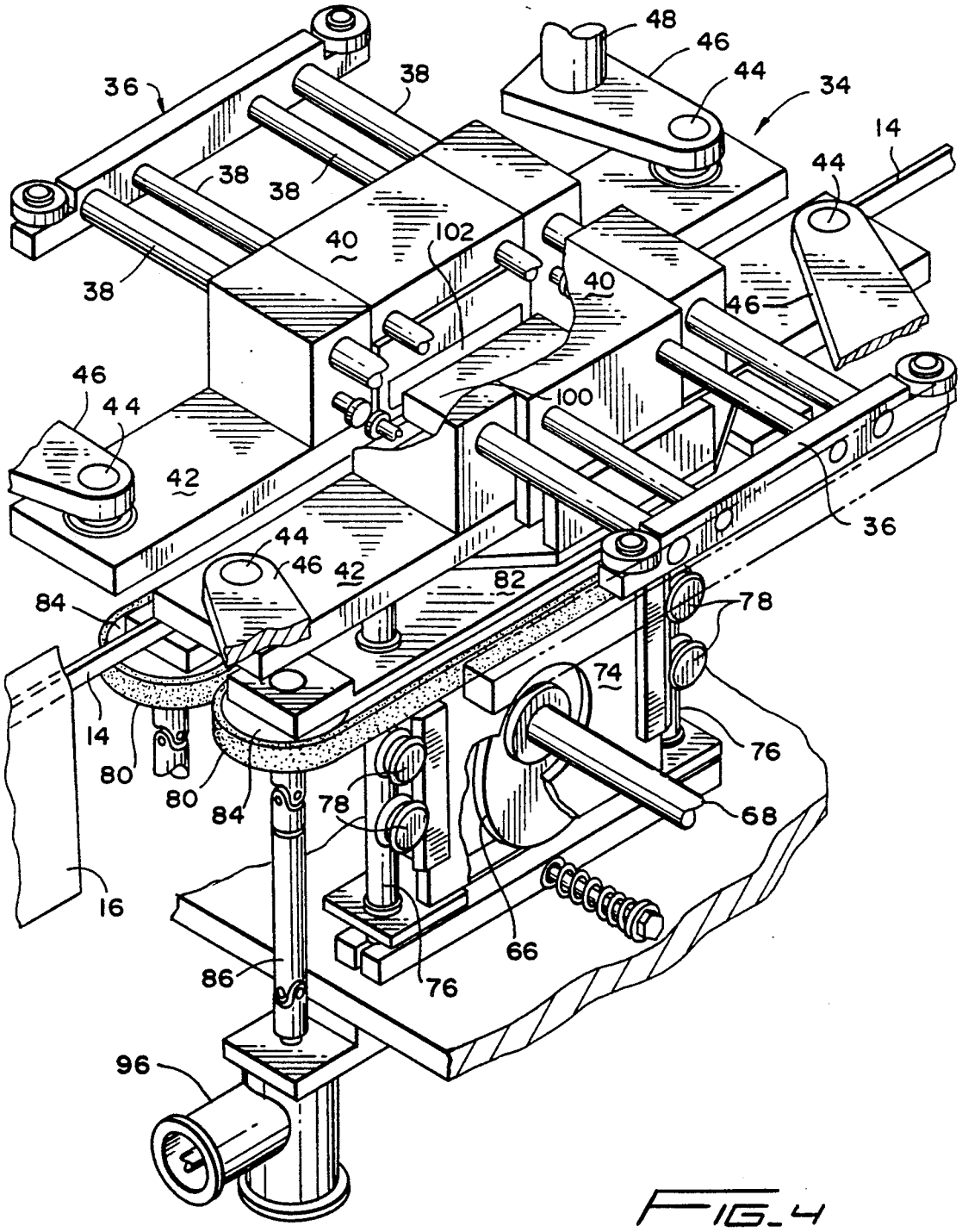
FIG. 4 is a perspective view of the die-cutting apparatus.

FIG. 4 is a perspective view of the die-cutting apparatus 20 of FIG. 1. The reciprocating cutting assembly 34 includes a pair of support bars 36 located on opposite sides of the gathering line 14. A series of support rods 38 extend between support bars 36 for slidably supporting the cutting blocks 40.

Cutting blocks 40 are mounted on reciprocating plates 42 on opposite sides of the gathering line 14. Each of the reciprocating plates 42 are pivotably attached at pivot points 44 to a pair of pivot arms 46. Pivot arms 46 are rotated by shafts 48. Rotation of shafts 48 causes plates 42 to reciprocate toward and away from the axis of the gathering line 14 as they slide in a linear direction on support rods 38.

Figure 5:
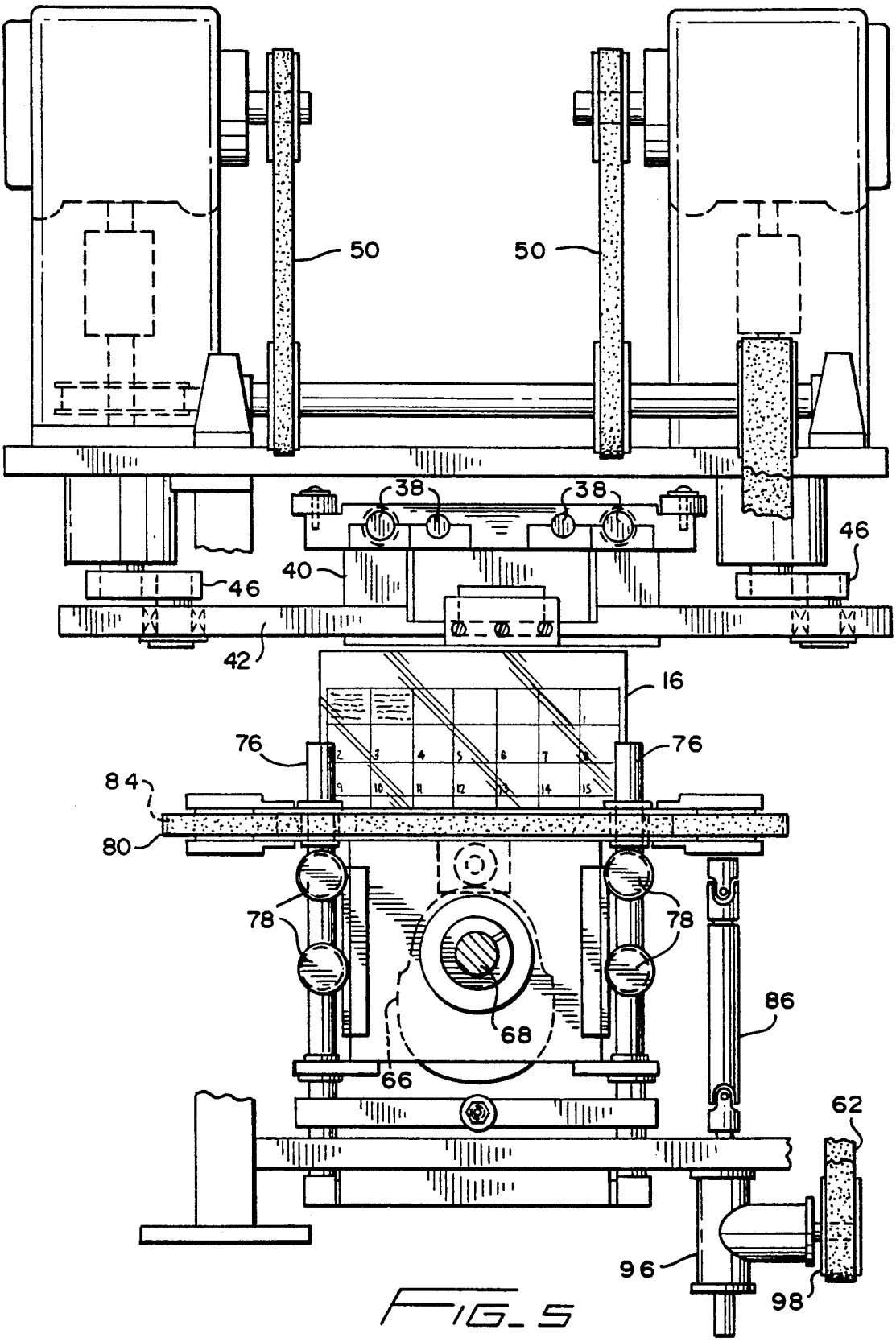
FIG. 5 is a side view of the die-cutting apparatus and showing the upper drive mechanism and the lower eccentric drive wheel.
Figure 9:
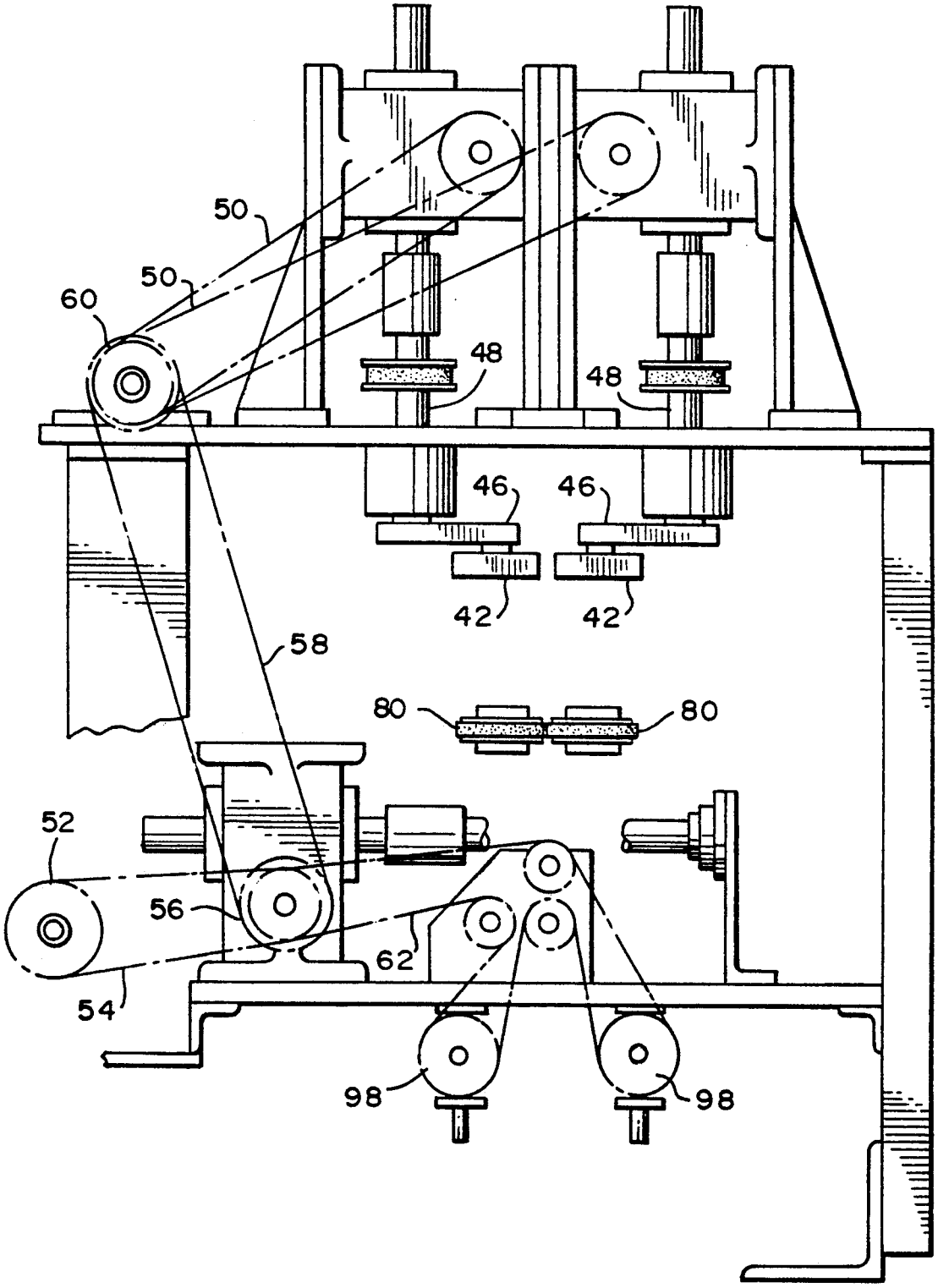
FIG. 9 is an end view of the die-cutting apparatus with portions broken away to reveal the drive apparatus which maintains the synchronization of the machine.

As best shown in FIGS. 5 and 9, rotating shafts 48 are driven by drive belts 50. The belt drive system is shown schematically in FIG. 9 wherein all of the belts are driven off a main drive shaft 52 so that the die-cutting apparatus 20 can be synchronized. Belt 54 extends from main drive shaft 52 to an intermediate drive shaft 56 which is turned by belt 54. Belt 58 rotates around intermediate drive shaft 56 and transfers the rotational motion to upper drive shaft 60. Belts 50 are connected to upper drive shaft 60 which are mechanically connected by conventional gearing apparatus to rotate shafts 48. Belt 62 is also connected to intermediate drive shaft 56 and operates to drive the lifting assembly 64.

As best shown in FIGS. 4 and 5, the lifting assembly 64 is moved in the vertical direction by the action of a pair of eccentric camming members 66 driven by shaft 68. Shaft 68 is driven by the intermediate drive shaft 56 as shown in FIG. 9.

Now referring back to FIGS. 4, 5 and 6, the eccentric camming members 66 rotate to engage lifting bars 70 which ride on the edge 72 of the camming member 66 and reciprocate up and down in response to the rotation of the eccentric camming member 66.

Each camming member 66 rotates within its own plate housing 74 which forms an enclosure around the camming member 66. Plate housing 74 moves up and down and is retained in side by side relation to retaining posts 76 by guide wheels 78.

The purpose of the lifting assembly 64 is to allow rotating belts 80 to grip the signature set 16 and lift it as gathering line 14 moves the signature set 16 along.

To keep the signature set 16 in horizontal motion with gathering line 14 as lifting assembly 64 is raising the signature set 16, a pair of belts 80 are mounted on top of the lifting plate housing 74. Lifting belts 80 are secured to the lifting assembly 64 by lifting belt plate 82 having a pulley 84 at each end thereof to support each belt 80 for rotational movement. Each belt 80 is rotated by the rotational movement of rotating shaft 86 acting on one of the pulleys 84.

Figure 8:
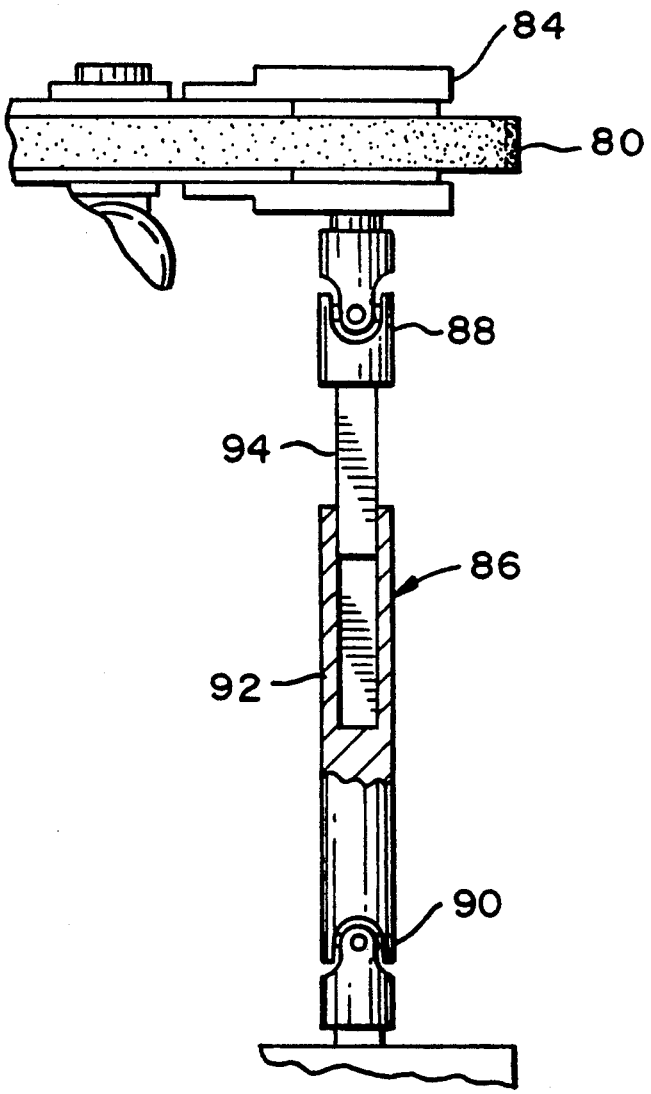
FIG. 8 is a cross-sectional view of one of the lifting cylinders with portions broken away to show the interior sleeve.

The rotating shaft 86 is best shown in FIG. 8. Pulley 84 is directly connected to rotating shaft 86. One of the lifting belts 80 is connected for receiving the rotational movement of pulley 84 and convert it to movement of the lifting belt 80. Rotating shaft 86 includes a pair of two directional pivot points 88 and 90 to give the shaft 86 a degree of movement to account for the change in angle as belt 88 is lifted. Shaft 86 includes a two part telescoping section having an exterior sleeve 92 and an interior bar 94. Bar 94 is generally formed in a squared or flat shape to prevent rotation relative to the squared or flat interior of sleeve 92. As shown in FIG. 8, interior bar 94 telescopes out of sleeve 92 when the lifting belt 80 is raised by the action of the eccentric camming member 66. Rotational movement is imparted to rotating shaft 86 through a gear mechanism 96 which converts the rotational motion about a horizontal axis of pulley 98 into a rotation about a vertical axis to rotating shaft 86. Pulley 98 is rotated by belt 62 as can be seen in FIGS. 5 and 9.

Figure 6:
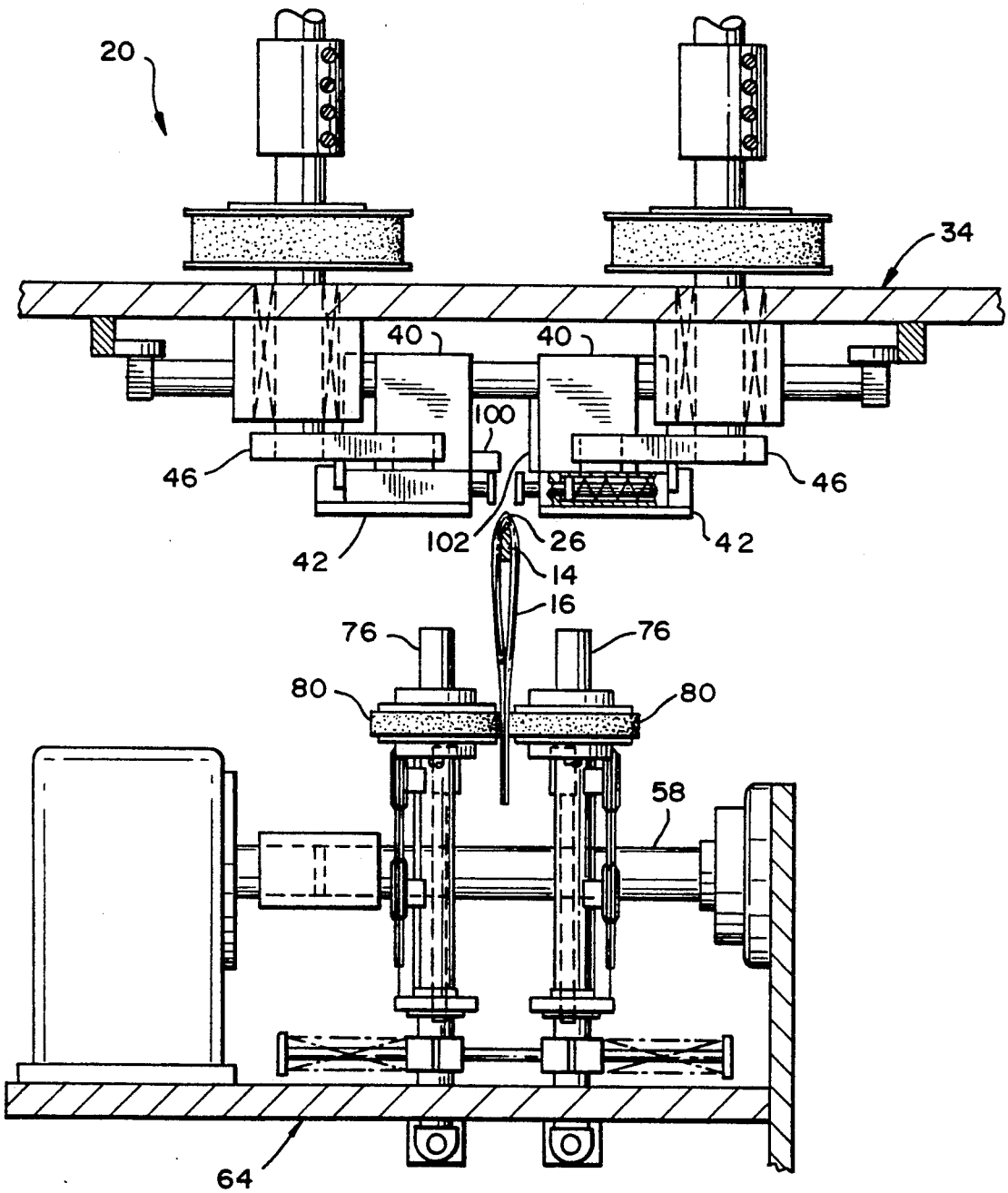
FIGS. 6 and 7 are sequential views showing grasping of the signature as it rests on the gathering line and raising the signature for cutting.

The operation of the die-cutting apparatus 20 will now be described with respect to FIGS. 6 and 7. FIG. 6 shows the signature set 16 being grasped by the lifting belts 80 as it is carried along gathering line 14. As the signature set 16 is grasped between the two lifting belts 80, the cutter 34 is initially open to receive the spine 26 of the signature set 16 between the coacting die plates 100 (male) and 102 (female). Die plates 100 and 102 are mounted on cutting blocks 40. The male die plate 100 has a sharpened edge for severing a portion of the signature 16 along the spine 26 thereof. The female die plate includes a recess 104 for receiving the cut out portion of spine 26.

Figure 7:
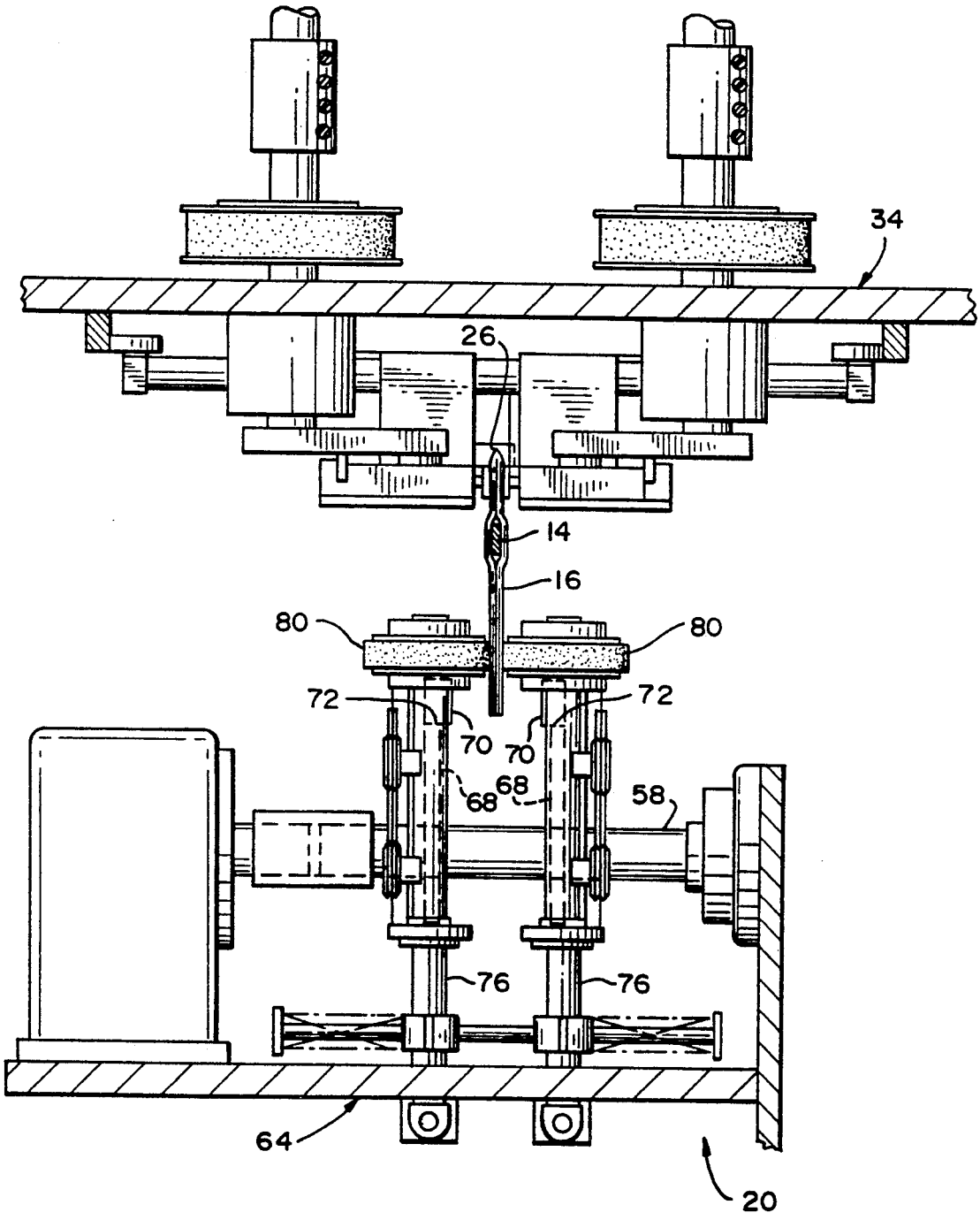

FIG. 7 shows the signature set 16 lifted by the lifting assembly 64 and being held in position by lifting belts 80 as it is moved along conveyor line 14. The spine 26 of the signature set 16 is raised above the gathering line 14 as the lifting belts 80 raise the signature set 16 as the lifting belts 80 are themselves lifted by the plate housings 74 and ride up retaining posts 76.

Cutter assembly 34 moves into position to cut along the spine 26 of signature set 16 when signature set 16 is being lifted to nearest highest point, die plates 100 and 102 engage each other and sever a portion of the signature set along the spine 26.

To ensure a uniform cut a pair of pressure pins 106 control the signature set in position as cutting occurs.

In order to reduce waste, feeder control units are used to determine if the apparatus is functioning properly. An example of a feeder control unit is shown in FIG. 1. An electronic eye 108 reads a bar code or reflective surface 110 on each outer signature 10. After each signature is dropped, an electronic eye reads a predetermined code or indicia on the signature and determines if successive feeders 18, 20 and 24 should drop their signatures 10 onto gathering line 14. If the proper code 110 is not present, successive feeders 18, 20 and 24 skip feeding onto that particular signature set and additional signatures and cover are not wasted; as well by means of disengaging the clutch in the lifter assembly, incomplete signature sets will not be die cut.

While this invention has been described as having a preferred design it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention and the limits of the appended claims.

What is claimed is:

1. A method of cutting common, formed openings in folded sheets, comprising the steps of:

a) placing a series of folded sheets on a conveyor means, each sheet being supported at its fold line;

b) aligning a plurality of said sheets together;

c) cutting a common, formed opening in said plurality of sheets; and, d) joining said sheets to form a set.

2. The method as set forth in claim 1, further comprising:

a) gathering a set of sheets including collecting individual sheets from a series of feeders located along said conveyor means.

3. The method as set forth in claim 1, further comprising:

a) lifting the sheets relative to the conveyor means before cutting.

4. A method of in-line die-cutting in saddle signature gathering, said method comprising the steps of:

a) gathering a set of signatures on a gathering line means;

b) engaging the set with lifting means to raise a portion of the set over said gathering line means;

c) cutting a portion of the set over the gathering line means; and, d) returning the set after cutting to the gathering line means.

5. The method of in-line die-cutting as set forth in claim 4, wherein:

a) stopping the set of signatures during the steps of in-line die-cutting.

6. The method of in-line die-cutting as set forth in claim 4, wherein:

a) said set of signatures forms a calendar.

7. The method of in-line die-cutting as set forth in claim 4, including:

a) adding a cover to the signature set after the cutting step.

8. An apparatus for die-cutting signatures in saddle format, said apparatus comprising:

a) a gathering line means for collecting signatures in saddle format;

b) lifting means for raising the signatures off said gathering line means;

c) means for cutting the signatures when they are lifted and, d) means for returning the signatures to the gathering line means.

9. The apparatus for die-cutting signatures as set forth in claim 8, further comprising:

a) said lifting means includes means for moving the signatures horizontally.

10. The apparatus for die-cutting signatures as forth in claim 8, wherein:

a) said lifting means and said means for cutting move in synchronized patterns.

11. The apparatus for die-cutting signatures as set forth in claim 8, wherein:

a) said lifting means includes a pair of rotating belts for grasping and lifting signatures.

12. The apparatus for die-cutting signatures as set forth in claim 8, wherein:

a) said means for cutting the signatures moves in reciprocating motion.

13. The apparatus for die-cutting signatures as set forth in claim 12, wherein:

a) said means for cutting is located above said gathering line means.

14. The apparatus for die-cutting signatures as set forth in claim 8, wherein;

a) said lifting means is located below said gathering line means.

15. The apparatus for die-cutting as set forth in claim 8, wherein:

a) said gathering line means is an endless chain.

16. A method of cutting common, formed openings in folded sheets, comprising the steps of:

a) placing a series of folded sheets on a conveyor, each sheet being supported at its fold line;

b) aligning a plurality of said sheets together;

c) cutting a common, formed opening in said plurality of sheets; and d) joining said sheets to form a set.

17. The method as set forth in claim 16, further comprising the step of:

a) gathering a set of sheets including collecting individual sheets from a series of sheet feeders located along said conveyor.

18. The method as set forth in claim 16, further comprising the step of:

a) lifting said sheets relative to the conveyor before cutting.

* * * * *